US006675822B1

(12) United States Patent
Schmitz et al.

(10) Patent No.: US 6,675,822 B1
(45) Date of Patent: Jan. 13, 2004

(54) CONCRETE DISTRIBUTING BOOM FOR CONCRETE PUMPS

(75) Inventors: Rolf Schmitz, Waldenbuch (DE); Dieter Schillinger, Neuhausen (DE)

(73) Assignee: Putzmeister AG, Aichtal (DE)

( * ) Notice: Subject to any disclaimer, the term of this patent is extended or adjusted under 35 U.S.C. 154(b) by 0 days.

(21) Appl. No.: 10/149,180

(22) PCT Filed: Oct. 24, 2000

(86) PCT No.: PCT/EP00/10444

§ 371 (c)(1),
(2), (4) Date: Jun. 7, 2002

(87) PCT Pub. No.: WO01/42591

PCT Pub. Date: Jun. 14, 2001

(30) Foreign Application Priority Data

Dec. 3, 1999 (DE) ..... 199 59 070

(51) Int. Cl.[7] ..... E04G 21/04; B67D 5/64
(52) U.S. Cl. ..... 137/15.09; 137/615; 141/387
(58) Field of Search ..... 137/615, 15.09, 137/15.08; 141/387

(56) References Cited

U.S. PATENT DOCUMENTS 3,685,543 A * 8/1972 Schwing et al. ..... 137/615
3,784,035 A * 1/1974 Dunbar ..... 414/543
4,280,771 A * 7/1981 Schwing et al. ..... 405/150.1
4,510,971 A * 4/1985 Bunnelle ..... 137/615
4,511,048 A * 4/1985 Volakakis et al. ..... 212/253
5,535,780 A * 7/1996 Schlecht et al. ..... 137/615

FOREIGN PATENT DOCUMENTS

JP 60047162 3/1985

* cited by examiner

*Primary Examiner*—Kevin Lee
(74) *Attorney, Agent, or Firm*—Pendorf & Cutliff

(57) ABSTRACT

The invention relates to a concrete distributing boom for mobile and stationary concrete pumps. The inventive boom is provided with a substructure (14, 14', 14"), a pillow block (32) that can be rotated around a vertical axis on the substructure and a stack of arms (16) consisting of several mast arms (34, 34', 34") that can be pivoted against each other. The first mast arm (34) is articulated to a hinge (36) of the pillow block (32). Moreover, a drive mechanism (38) is provided that is provided with a driving pinion (42) for rotatably driving the pillow block (32). Said pinion (42) can preferably be rotated around a vertical axis by means of toothed racks (40). The aim of the invention is to enable to easily change masts between different substructures (14, 14', 14"). The pillow block (32) that is connected to the stack of arms (16) can be detachably coupled to the driving pinion (42) which is arranged in the substructure.

17 Claims, 3 Drawing Sheets

CONCRETE DISTRIBUTING BOOM FOR CONCRETE PUMPS

CROSS-REFERENCE TO RELATED APPLICATION

This application is a national stage of PCT/EP00/10444 filed Oct. 24, 2000 and based upon DE 199 59 070.2 filed Dec. 8, 1999 under the International Convention.

BACKGROUND OF THE INVENTION

1. Field of the Invention

The invention concerns a distribution boom for concrete pumps, with a mounting block seated on a substructure and rotatable about a vertical axis, with a multiple-arm assembly, comprised of multiple mast arms pair-wise pivotable relative to each other and carrying a cement conduit, of which the first mast arm is linked to a rotatable hinge of the mounting block, and a drive pinion rotatable about a vertical axis via a rack for the rotational drive of the mounting block.

2. Description of the Related Art

Cement distribution masts of this type are mounted on mobile or stationary substructures and have their cement line connected to the pressure connection of a concrete pump. The drive pinion is conventionally fixedly connected with the mounting block, preferably is welded permanently thereto. During assembly, the distribution boom together with drive pinion is first introduced into the drive mechanism and then screwed together with the substructure. Therein much care is necessary so that the teeth of the drive pinion and the rack are not damaged. For this reason, the assembly is usually undertaken or approached from the gear side. On the other hand, many construction sites cannot be serviced with mobile cement pumps due to their size or due to lack of space. There, stationary substructures are necessary, upon which the distribution boom is to be seated. It would thus be advantageous if the distribution boom could simply be removed from a mobile concrete pump and seated upon a stationary boom.

SUMMARY OF THE INVENTION

Beginning therewith, it is the task of the present invention to construct a distribution boom for concrete pumps, which can be simply mounted upon different substructures.

The inventive solution is based upon the concept, that the construction components associated with the drive mechanism of the distribution boom should be completely integrated in the substructure, so that a simple boom exchange is possible. In order to accomplish this, it is proposed in accordance with the invention, that the mounting block associated with the arm assembly is releasably couplable with a drive pinion associated with the substructure.

According to a preferred embodiment of the invention the drive pinion includes a coaxial alignment pin projecting above the substructure and at least one eccentric arranged or oriented rotation drive element, while the mounting block includes a receiving bushing complimentary to the alignment pin and releasably seated thereupon as well as at least one driven element releasably couplable with the rotation drive element. Herein the at least one rotation drive element is preferably associated with a preferably plate-shaped bracket or boom which projects radially beyond the locating pin. Coupling pins can be provided projecting axially parallel to the locating pin projecting above or beyond the bracket or boom, which are insertable in a complimentary driven borehole in the mounting block and there preferably are securable against being withdrawn. In the kinematic reverse, the at least one rotation drive element can also be designed as a borehole provided in the bracket axially parallel to the alignment pin, in which a complimentary driven pin of the mounting block is insertable, and is preferably restrained there against being withdrawn. The rotation drive element on the substructure side and the driven parts on the mounting block side are preferably form-fittingly couplable with each other, preferably via pins.

A preferred or advantageous further development of the invention envisions that the receiving bushing is seated with a downwardly directed opening rigidly in the mounting block, preferably is welded therein. The mounting block preferably exhibits an bracket or bracket projecting radially to the side of the bushing opening, preferably plate shaped, forming the driven part, which during the coupling process is seatable upon the bracket on the substructure side. Preferably two rotation drive elements are provided preferably diametrically opposite each other relative to the locating pin.

For simplification of assembly the locating pins, the receiving bushing and/or the at least one rotation drive element can exhibit an insertion cone for facilitating reception of the respective complimentary part.

Preferably, the inventive distribution boom is used as an interchangeable or change out boom for mobile and stationary substructures.

BRIEF DESCRIPTION OF THE DRAWING

In the following the invention will be described in greater detail on the basis of an embodiment schematically represented in the figure. There is shown FIG. 1 a side view of a mobile substructure and two stationary substructures for a distribution boom formed as an exchangeable boom.

DETAILED DESCRIPTION OF THE INVENTION

Figure 1:
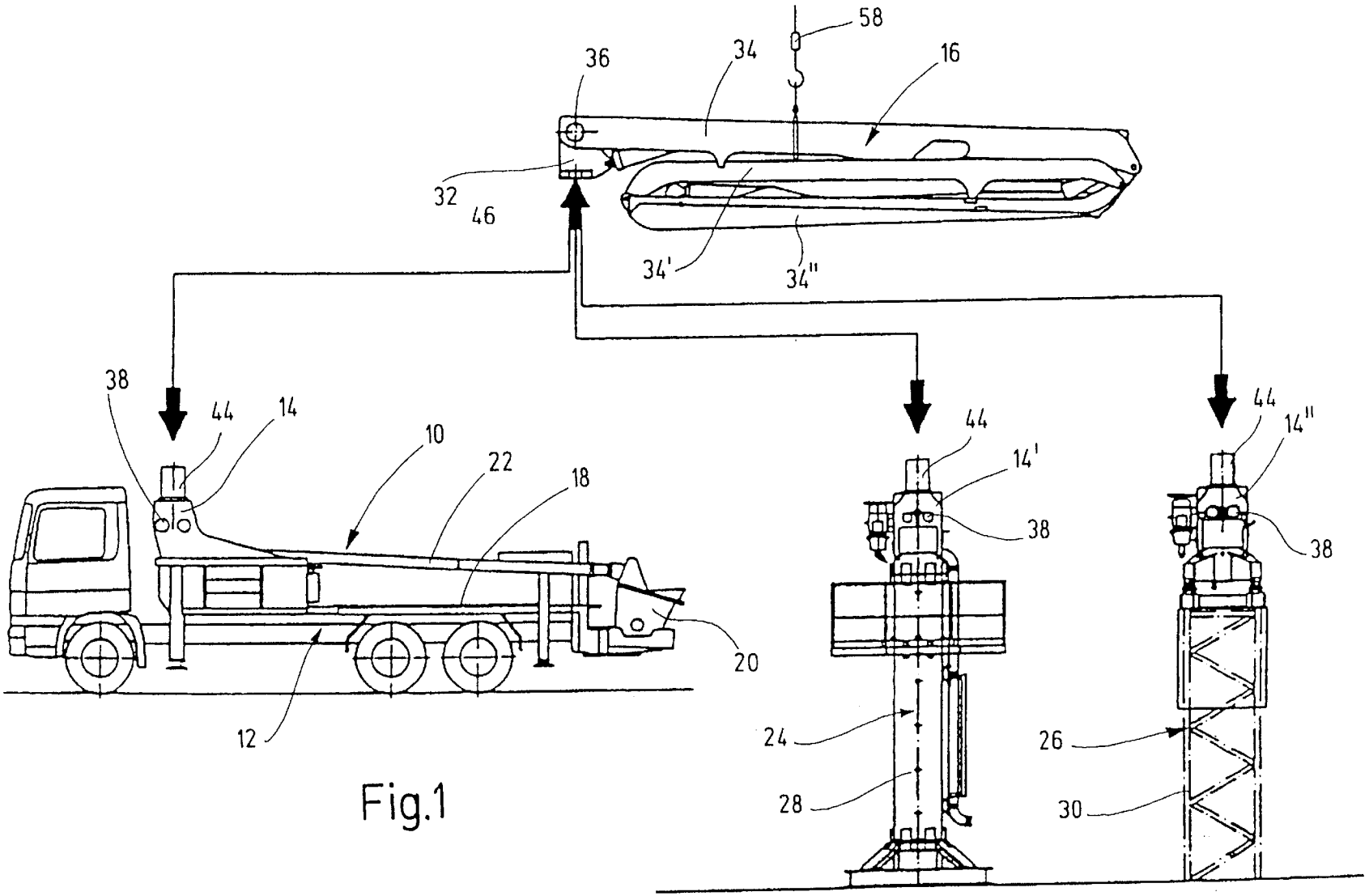
Figure 2:
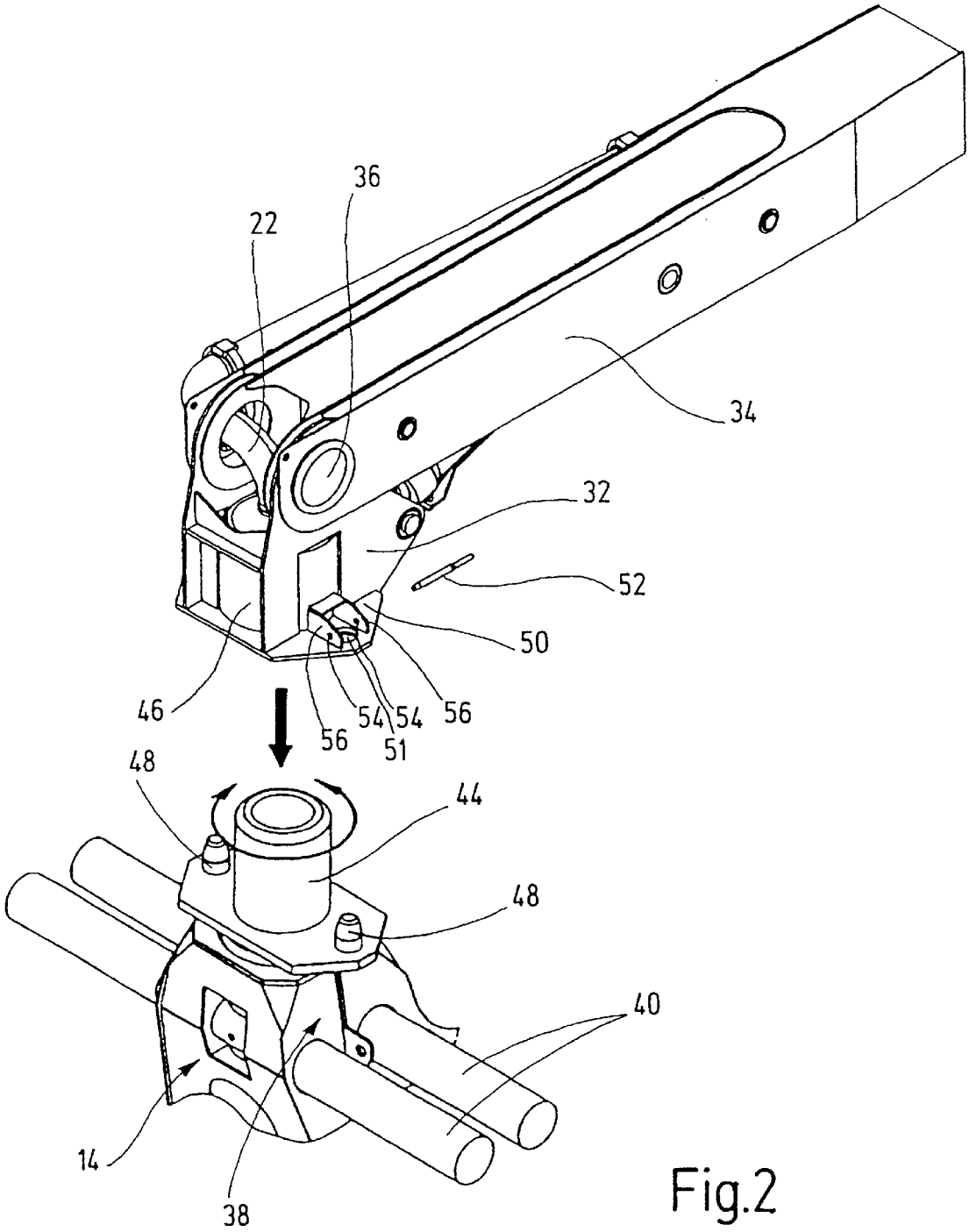
FIG. 2 a section of a set of arms and the substructure of the distribution boom in perspective representation during the assembly.
Figure 3:
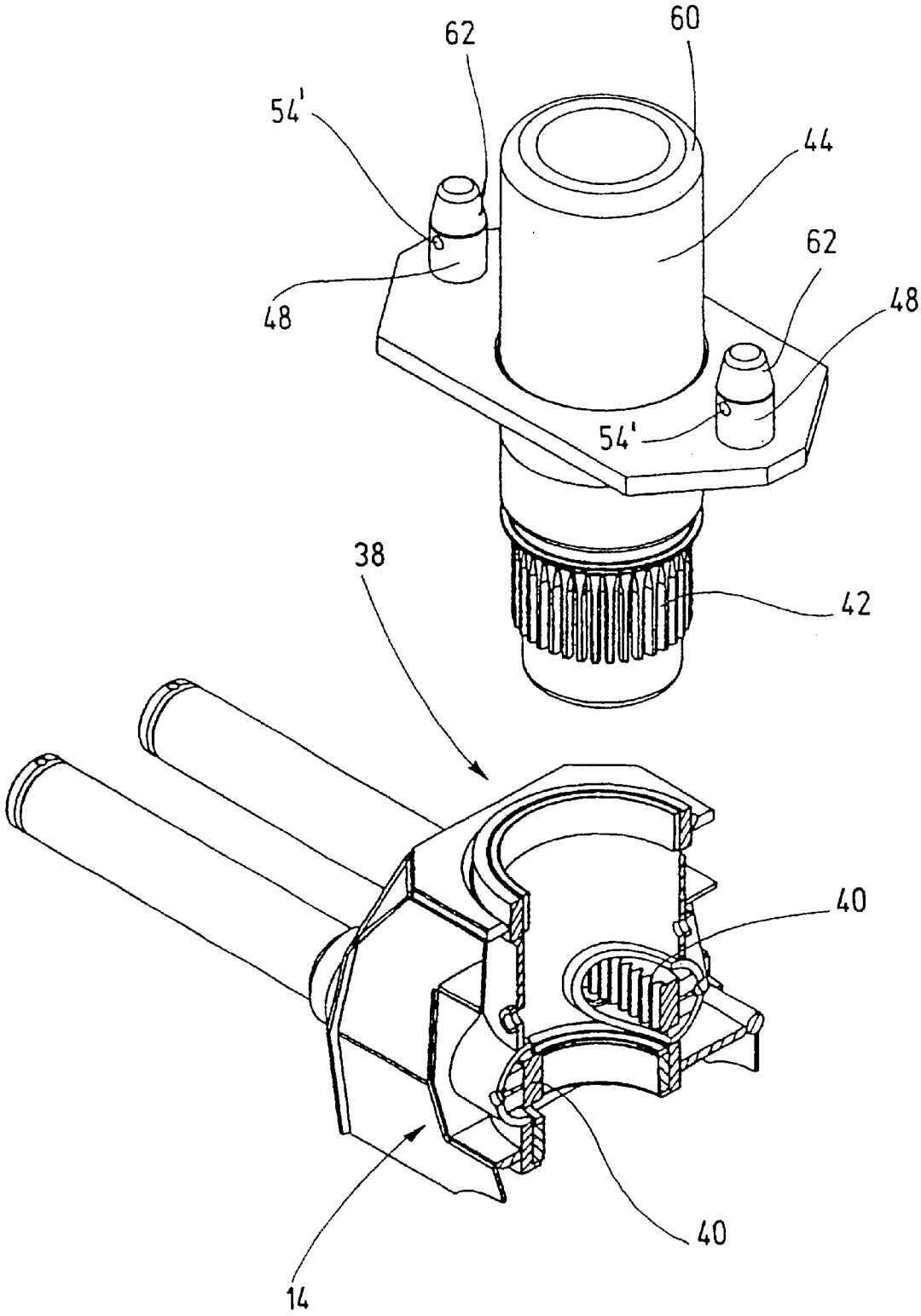
FIG. 3 a perspective, partial cut-away exploded representation of the substructure-side drive mechanism of a distribution boom.

The distribution boom shown in the figure is designed for mobile or stationary concrete pumps. The mobile concrete pump 10 shown in FIG. 1 includes a substructure 14 provided on a vehicle chassis 12 for receiving the set of arms 16. On the chassis 12 is mounted the conveyor pump 18 with material supply container 20, of which the delivery line is connected to the cement line 22 of the distribution boom. The stationary concrete pumps 24, 26 shown supplementally in FIG. 1 include a pipe column 28, or as the case may be, a grid framework 30, which carry on their upper part the respective stationary substructures 14', 14" of the distribution boom.

The distribution boom includes a mounting block 32 rotatable about a vertical axis upon the substructure 14, 14', 14" as well as an arm assembly 34. The arm assembly is comprised of multiple arms pivotable pair-wise relative to each other, the cement conduit 22 carried by the mast arms 34, 34', 34", of which the first mast arm 34 is linked at the mounting block 32 via a rotation linkage 36 with horizontal axis. The preferably hydraulic operated drive mechanism 38 for the driving of the mounting block 32 is completely integrated in the substructure 14, 14', 14". It includes a drive pinion 42 provided in the substructure, rotatable about a vertical axis via two racks 40, and releasably couplable with the mounting block 32 of the arm assembly 16. The drive pinion 42 is, for this purpose, rigidly connected with a coaxial locating pin 44 which projects above the substructure 14, 14', 14", while the mounting block 32 exhibits a downwardly open receiving bushing 46 complimentary to and releasably seatable upon locating pin 44. Besides this, the drive pinion 42 is rigidly connected with two, eccentric arranged rotation drive elements 48, which in the illustrative embodiment are in the form of drive pins. Accordingly, the mounting block 32 includes two eccentric projecting driven parts 50, which are provided with two boreholes 51 couplable with the drive pins 48. For simplification of assembly the locating pins 44 and the drive pins 48 respectively exhibit an insertion cone 60, 62. In the assembled condition the mounting block 32 is secured on the side of the arm assembly by pins with the substructure locating pins 44, with the aid or help of the pins 52, which are insertable through opposing aligned boreholes 54, 54' in the cover or link plate 56 and through the drive pins 48. The locating pins 44 and the receiving bushings 56 serve for taking up the tilt moment of the distribution boom, while the drive pins 48 and the complimentary driven boreholes 50 transmit the torque from the drive mechanism 38 upon the mast.

In accordance with the described measures it is possible to release the arm assembly 16 with mounting block 32 from the substructure 14, 14', 14" with few manipulative steps, and to mount this upon a different substructure. For this, the pin connections 52 must be released, so that the arm assembly 16 can be lifted from the locating pin 44 of the one substructure using a crane 58 and seated upon the locating pin 44 of another substructure and there again be connected via the pins.

In summary the following can be concluded: The invention relates to a concrete distributing boom for mobile and stationary concrete pumps. The inventive boom is provided with a substructure 14, 14', 14", a mounting block 32 that can be rotated around a vertical axis on the substructure and a set of arms 16 consisting of several mast arms 34, 34', 34" that can be pivoted relative to each other. The first mast arm 34 is articulated to a hinge 36 of the mounting block 32. Moreover, a drive mechanism 38 is provided, that is provided with a driving pinion 42 for rotatably driving the mounting block 32. Said pinion 42 can preferably be rotated around a vertical axis by means of toothed racks 40. The aim of the invention is to make it possible to easily change masts between different substructures 14, 14', 14". The mounting block 32 that is connected to the set of arms 16 can be detachably coupled to the driving pinion 42 provided on the substructure.

What is claimed is:

1. A distribution boom for concrete pumps, comprising:

a substructure (14, 14', 14"), a mounting block (32) seatable upon the substructure and rotatable about a vertical axis, an arm assembly (16) comprised of multiple mast arms (34, 34', 34"), pair-wise pivotable relative to each other, of which the first mast arm (34) is linked to a rotation linkage (36) of the mounting block (32), a concrete line (22) carried by the arm assembly, and a drive mechanism (38), comprising a drive pinion (42) rotatable about a vertical axis, for driving the mounting block (32), wherein the mounting block (32) connected to the set of arms (16) is releasably couplable with the drive pinion (42) associated with the substructure (14, 14', 14"), wherein the drive pinion (42) includes a coaxial locating pin (44) projecting above the substructure and at least one eccentric positioned drive element (48), and wherein the mounting block (32) includes a receptacle bushing (46) complimentary to the locating pin (44) and releasably seatable thereupon as well as at least one driven part (50) releasably couplable with the drive element (48).

2. A distribution boom according to claim 1, wherein the drive mechanism (38) comprises a rack (40) engageable with the drive pinion (42).

3. A distribution boom according to claim 1, wherein the locating pin (44) includes a central borehole for the passage therethrough of the concrete line (22).

4. A distribution boom according to claim 1, wherein the at least one rotation drive element (48) is provided on a bracket projecting radially beyond the locating pin (44).

5. A distribution boom according to claim 3, wherein the at least one rotation drive element (48) is in the form of a coupling pin projecting above the bracket and axially parallel to the locating pin (44), adapted to be introduced in a complimentary driven borehole in the mounting block side driven part (50).

6. A distribution boom according to claim 5, wherein the at least one rotation drive element (48) is in the form of an in the bracket provided borehole axially parallel to the locating pin (44), in which a complimentary, mounting block side driven pin is insertable and there is preferably securable against extraction.

7. A distribution boom according to claim 1, wherein the receiving bushing (46) with downwards directed opening is rigidly seated in the mounting block (32), preferably is welded therein.

8. A distribution boom according to claim 5, wherein the mounting block (32) includes a bracket forming the driven part (50), preferably projecting radially on the side of the block or bushing opening, preferably plate shaped, which during the coupling process is seatable or supported upon the bracket on the substrate side.

9. A distribution boom according to claim 1, wherein the locating pin (44) includes on its end an insertion cone (60).

10. A distribution boom according to claim 1, wherein the receiving bushing (46) includes an insertion cone-shaped opening.

11. A distribution boom according to claim 1, wherein at least one of the rotation drive element (48) and the driven part (50) includes an insertion cone (62) for the respective complimentary part.

12. A distribution boom according to claim 1, wherein two rotation drive elements (48) are provided diametrically opposite to each other relative to the locating pin (44).

13. A distribution boom according to claim 1, wherein the drive elements (48) of the substructure and the driven elements (50) on the mounting block side are formed fittingly couplable with each other preferably via pins (52).

14. A distribution boom according to claim 1, wherein said drive means is a hydraulic drive means.

15. A distribution boom according to claim 1, wherein said bracket is disc or plate shaped.

16. A distribution boom according to claim 5, wherein the at least one rotation drive element (48) is in the form of a coupling pin projecting above the bracket and axially parallel to the locating pin (44), adapted to be introduced in a complimentary driven borehole in the mounting block side driven part (50), and there is securable against being pulled out.

17. A method for changing a mast on a concrete distribution boom, comprising:

(a) providing distribution boom for concrete pumps, comprising (i) a substructure (14, 14', 14"), (ii) a mast comprising a mounting block (32) seatable upon the substructure and rotatable about a vertical axis, an arm assembly (16) comprised of multiple mast arms (34, 34', 34"), pair-wise pivotable relative to each other, of which the first mast arm (34) is linked to a rotation linkage (36) of the mounting block (32), and (iii) a concrete line (22) carried by the arm assembly, and a drive mechanism (38), comprising a drive pinion (42) rotatable about a vertical axis, for driving the mounting block (32), wherein the mounting block (32) connected to the set of arms (16) is releasably couplable with the drive pinion (42) associated with the substructure (14, 14', 14"), wherein the drive pinion (42) includes a coaxial locating pin (44) projecting above the substructure and at least one eccentric positioned drive element (48), and wherein the mounting block (32) includes a receptacle bushing (46) complimentary to the locating pin (44) and releasably seatable thereupon as well as at least one driven part (50) releasably couplable with the drive element (48), (b) removing said mast from said substructure, and (c) introducing a different mast onto said substructure.

* * * * *